US006176204B1

(12) United States Patent
Heer

(10) Patent No.: US 6,176,204 B1
(45) Date of Patent: Jan. 23, 2001

(54) COOLING WATER PUMP FOR AN INTERNAL COMBUSTION ENGINE

(75) Inventor: Siegfried Heer, Kirchdorf/Krems (AT)

(73) Assignee: TCG Unitech Aktiengesellschaft, Krems (AT)

( * ) Notice: Under 35 U.S.C. 154(b), the term of this patent shall be extended for 0 days.

(21) Appl. No.: 09/419,638

(22) Filed: Oct. 18, 1999

(30) Foreign Application Priority Data

Oct. 22, 1998 (AT) ..... 1772/98

(51) Int. Cl.[7] ..... F01P 5/10

(52) U.S. Cl. ..... 123/41.44; 417/423.11; 417/423.12; 417/423.14

(58) Field of Search ..... 123/41.44; 417/423.11, 417/423.12, 423.14, 364

(56) References Cited

U.S. PATENT DOCUMENTS 4,961,404 * 10/1990 Itakura et al. ..... 123/41.31
5,040,494 * 8/1991 Okita et al. ..... 123/41.46
5,226,787 * 7/1993 Freeman ..... 415/168.2

FOREIGN PATENT DOCUMENTS 0208074 1/1987 (EP) .
1456938 12/1976 (GB) .
0651141 5/1995 (WO) .
9603574 2/1996 (WO) .

* cited by examiner

*Primary Examiner*—Willis R. Wolfe
*Assistant Examiner*—Katrina B. Harris
(74) *Attorney, Agent, or Firm*—Dykema Gossett PLLC

(57) ABSTRACT

A cooling water pump for an internal combustion engine, includes a flow conducting housing in which an impeller is arranged and a bearing part which is arranged separate from the flow conducting housing and provided with a bearing for the impeller. A simple and cost-effective production is achieved by arranging the flow conducting housing between an anchoring part and the bearing part, and such that the bearing part encompasses the flow conducting housing and is attached to the anchoring part.

8 Claims, 1 Drawing Sheet

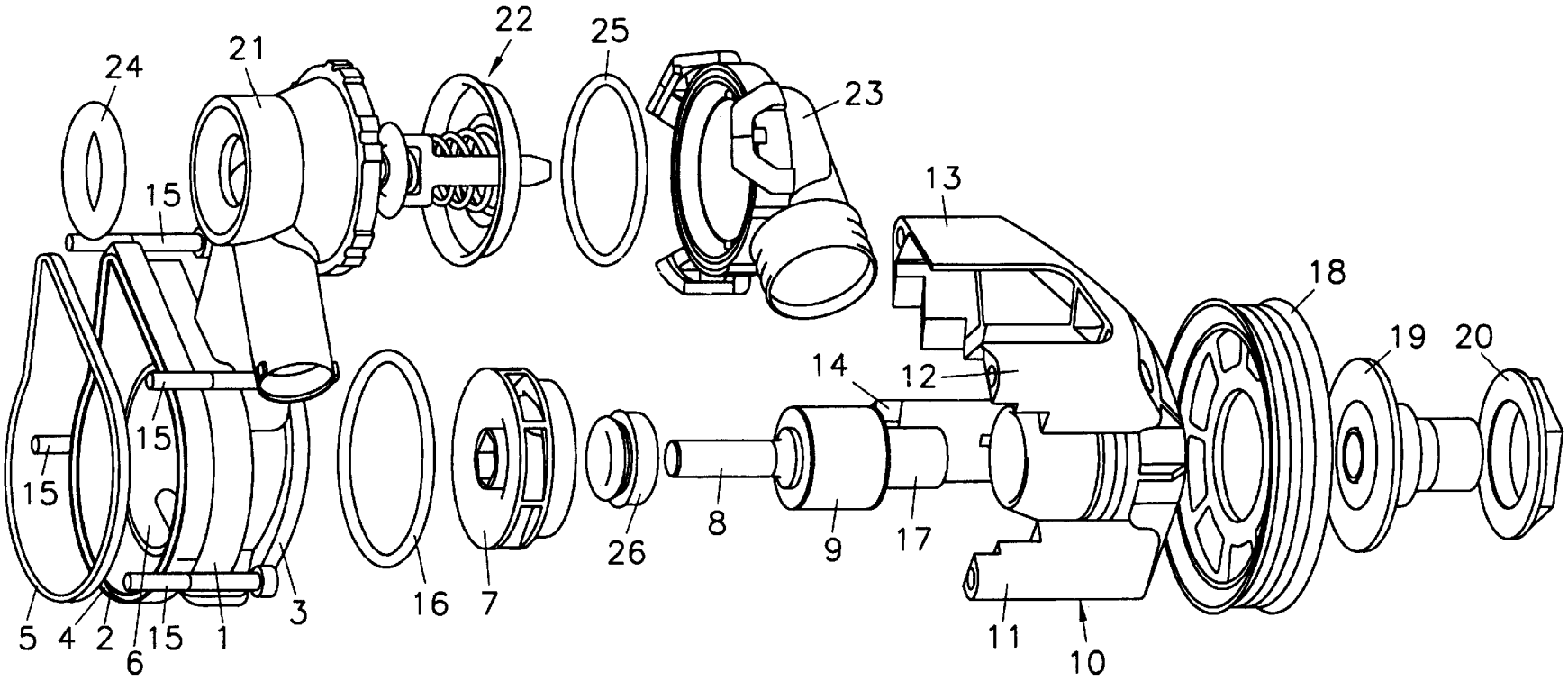
20
19
18
10
11
13
12
17
23
14
9
8
25
26
22
7
16
3
21
1
15
15
15
6
24
2
4
15
5

COOLING WATER PUMP FOR AN INTERNAL COMBUSTION ENGINE

BACKGROUND OF THE INVENTION

The invention relates to a cooling water pump for an internal combustion engine, having a flow conducting housing in which an impeller is arranged and a bearing part which is arranged separate from the flow conducting housing and is provided with a bearing for the impeller.

Cooling water pumps of internal combustion engines are usually arranged as radial or axial-radial pumps. The flow conducting housing of such pumps is generally a cast part made of aluminium or an other metallic material.

DESCRIPTION OF THE PRIOR ART

A cooling water circulating pump is known from EP 0 208 074 A in which individual parts are made of plastic. Such a cooling water circulating pump comes with the considerable advantage of easy and cost-effective production and generally has a lower weight than a cooling water circulating pump made of a metallic material. The lower strength of plastic, however, leads to relatively serious constructional limitations and to difficulties in achieving the required service life. Moreover, as a result of the lower stiffness of the plastic material it is necessary to provide higher tolerances between the impeller and the flow conducting housing, which leads to a reduction of the efficiency and thus to an increase of the required drive output.

A coolant pump is known from WO 96/03574 in which a bearing part and a flow conducting housing are arranged as separate components. However, since the flow conducting housing is required to absorb the forces acting on the bearing part, there are narrow limits concerning the dimensioning and the choice of material. The same applies to the solution shown in EP-A 651 141.

Furthermore, it is known from U.S. Pat. No. 5,040,494 A or GB 1 456 938 A to integrally arrange the bearing part and the flow conducting housing. It is necessary to make compromises in the shaping and the choice of materials, so that an optimal arrangement of the individual functional parts is not possible.

SUMMARY OF THE INVENTION

It is the object of the present invention to provide a cooling water pump with which it is possible to combine the advantages of the use of plastic materials with a simple arrangement and a high efficiency.

It is provided in accordance with the invention that the flow conducting housing is arranged between an anchoring part and a bearing part, and that the bearing part encompasses the flow conducting housing and is fastened to the anchoring part. The relevant aspect in the present invention is that the flow conducting housing, which is relatively complex in its shape, can be produced simply and at low cost. In particular, this flow conducting housing may be made of plastic, e.g. by injection moulding. The motor unit or the cylinder head of the internal combustion engine is used as an anchoring part for example, to which the cooling water pump is directly attached. The supply of cooling water for the internal combustion engine is thus particularly simple. Since the bearing part is directly connected with the anchoring part, i.e. the internal combustion engine or any other fixed component, the bearing of the impeller can occur in a particularly stiff and stable manner. The bearing part can be arranged as a simple cast part made of gray cast iron or cast aluminium which is worked in merely one single chucking on a lathe. In this arrangement, the flow conducting housing merely needs to absorb the forces required for sealing. Accordingly, a considerable reduction in weight can be achieved.

In a particularly preferable embodiment of the invention it is provided that the flow conducting housing is provided with a first and second sealing surface. The first sealing surface rests in a sealing manner on the anchoring part, whereas the second sealing surface rests in a sealing manner on the bearing part. Generally, the first and the second sealing surface will be arranged parallel with respect to one another at opposite sides of the flow conducting housing. In this way separate fastening of the flow conducting housing is not required, since the same is held between the anchoring part and the bearing part.

It is particularly favorable when grooves are provided in the flow conducting housing for receiving sealing elements so as to provide sealing towards the anchoring part and/or the bearing part. This allows a further simplification during the production.

BRIEF DESCRIPTION OF THE DRAWINGS

The present invention will now be explained in closer detail by reference to the enclosed drawing, wherein the figure shows an axonometric exploded view of a cooling water pump in accordance with the invention.

DETAILED DESCRIPTION OF THE PREFERRED EMBODIMENTS

The cooling water pump in accordance with the invention consists of a flow conducting housing 1 which is provided with a first sealing surface 2 and a second sealing surface 3. The second sealing surface 3 is not visible in the axonometric illustration. The first sealing surface 2 is provided to rest in a sealing manner on the cylinder block of an internal combustion engine (not shown). For this purpose a groove 4 is arranged in the sealing surface 2 which will receive a seal 5. The first sealing surface 2 encloses an opening 6 which in the assembled state forms a direct flow connection of the cooling water pump with the water cooling jacket of the internal combustion engine. An impeller 7 is arranged in the flow conducting housing which is attached to a shaft 8. A sliding bearing body 9 which is connected with shaft 8 is rotatably held in a bearing part 10. The bearing part 10 comprises four fastening legs 11, 12, 13 and 14 which encompass the flow conducting housing 1 in the assembled state. The bearing part 10 is attached to the internal combustion engine (not shown) through screws 15. An O-ring seal 16 seals the flow conducting housing against the bearing part 10.

A V-belt pulley 18 for driving the cooling water pump in accordance with the invention is fastened to a shaft butt end 17 opposite of shaft 8. A fastening element 19 with a nut 20 is used for fastening the V-belt pulley 18 to shaft butt end 17.

A thermostat housing is integrally connected to the flow conducting housing 1, which thermostat housing receives a thermostat 22. A lid 23 closes off the thermostat housing 21. Sealing washers 24 and 25 are used for sealing off the connections or aforementioned components among one another. An axial face seal 26 is used for external sealing.

The present invention allows producing the flow conducting housing of a cooling water pump in a simple and cost-effective manner. It is further possible to achieve a considerable reduction in weight whilst still maintaining the precise bearing of the impeller to the full extent.

I claim:

1. A cooling water pump for an internal combustion engine, having a flow conducting housing;

an impeller arranged in the flow conducting housing;

a bearing part which is arranged separate from the flow conducting housing and is provided with a bearing for the impeller, wherein the flow conducting housing is arranged between an anchoring part and the bearing part, and the bearing part encompasses the flow conducting housing and is attached to the anchoring part.

2. A cooling water pump according to claim 1, wherein the anchoring part is a component of the internal combustion engine.

3. A cooling water pump according to claim 1, wherein the flow conducting housing is provided with a first sealing surface which is arranged to rest in a sealing manner on the anchoring part.

4. A cooling water pump according to claim 1, wherein the flow conducting housing is provided with a second sealing surface which is arranged to rest on the bearing part in a sealing manner.

5. A cooling water pump according to claim 1, wherein the bearing part is provided with at least three projecting fastening legs which rest on the anchoring part and are attached to the same, with the fastening legs externally encompassing the flow conducting housing.

6. A cooling water pump according to claim 1, wherein the flow conducting housing is made of plastic.

7. A cooling water pump according to claim 1, wherein the flow conducting housing is integrally arranged with a thermostat housing.

8. A cooling water pump according to claim 1, wherein grooves are provided in the flow conducting housing for receiving sealing elements for providing sealing against the anchoring part and/or the bearing part.

* * * * *

UNITED STATES PATENT AND TRADEMARK OFFICE

CERTIFICATE OF CORRECTION

PATENT NO. : 6,176,204 B1
DATED : January 23, 2001
INVENTOR(S) : Siegfried Heer

It is certified that error appears in the above-identified patent and that said Letters Patent is hereby corrected as shown below:

Title Page,
Item [73] Assignee: TCG Unitech Aktiengesellschaft
Kirchdorf/Krems (AT)

Signed and Sealed this

Third Day of July, 2001

*Attest:*

Nicholas P. Godici

*Attesting Officer*

NICHOLAS P. GODICI
*Acting Director of the United States Patent and Trademark Office*